US010905208B2

(12) United States Patent
Berka et al.

(10) Patent No.: US 10,905,208 B2
(45) Date of Patent: Feb. 2, 2021

(54) JEWELRY WITH INTERCHANGEABLE DECORATIVE ELEMENTS

(71) Applicant: TALIA LUXURY GOODS, LTD., Herzliya (IL)

(72) Inventors: Ronen Berka, Ramat Hasharon (IL); Tal Man, Ramat Hasharon (IL)

(73) Assignee: TALIA LUXURY GOODS, LTD., Herzliya (IL)

( * ) Notice: Subject to any disclaimer, the term of this patent is extended or adjusted under 35 U.S.C. 154(b) by 350 days.

(21) Appl. No.: 14/902,597

(22) PCT Filed: Jul. 1, 2014

(86) PCT No.: PCT/IL2014/050581
§ 371 (c)(1),
(2) Date: Jan. 4, 2016

(87) PCT Pub. No.: WO2015/001551
PCT Pub. Date: Jan. 8, 2015

(65) Prior Publication Data

US 2016/0198817 A1 Jul. 14, 2016

Related U.S. Application Data

(60) Provisional application No. 61/842,973, filed on Jul. 4, 2013.

(51) Int. Cl.
*A44C 25/00* (2006.01)
*A44C 17/02* (2006.01)
(Continued)

(52) U.S. Cl.
CPC ..... *A44C 17/0208* (2013.01); *A44C 5/025* (2013.01); *A44C 13/00* (2013.01); *A44C 17/0241* (2013.01); *A44C 25/001* (2013.01)

(58) Field of Classification Search
CPC ..... A44C 5/02; A44C 5/022; A44C 5/025; A44C 17/0208; A44C 17/0233;
(Continued)

(56) References Cited

U.S. PATENT DOCUMENTS 4,353,225 A * 10/1982 Rogers ..... A44C 7/002 40/301
4,430,869 A 2/1984 Zinni
(Continued)

FOREIGN PATENT DOCUMENTS

DE 29604934 U1 5/1996
WO WO-2019106653 A1 * 6/2019 ..... A44C 13/00

OTHER PUBLICATIONS

Haba Ballino, Amazon (Year: 2008).*

*Primary Examiner* — Emily M Morgan
(74) *Attorney, Agent, or Firm* — Amster, Rothstein & Ebenstein LLP

(57) ABSTRACT

A jewelry system with interchangeable decorative segments is provided. The jewelry system includes a plurality of decorative segments, each such segment having a center aperture that extends through the segment along a vertical axis in the center of the segment from a top surface to a bottom surface. The jewelry system also includes a central rod for receiving one or more segments, the rod including a stopper at the lower end to support the received segments and an eyelet at the upper end to receive a chain which when received, prevents the received segments from slipping off the top part of the rod while also facilitating the jewelry to be worn.

18 Claims, 3 Drawing Sheets

(51) Int. Cl.
*A44C 13/00* (2006.01)
*A44C 5/02* (2006.01)

(58) Field of Classification Search
CPC ... A44C 17/0241; A44C 17/025; A44C 17/02; A44C 25/001; A44C 13/00
USPC ..... 63/40, 29.1
See application file for complete search history.

(56) References Cited

U.S. PATENT DOCUMENTS

| | | | | | |
|---|---|---|---|---|---|
| 4,879,882 | A * | 11/1989 | Johnson | A44C 15/004 | 63/13 |
| 5,836,176 | A * | 11/1998 | Lichtenstein | A44C 7/002 | 63/13 |
| 6,381,985 | B1 * | 5/2002 | Burgard | A44C 7/002 | 29/20 |
| 6,553,785 | B2 * | 4/2003 | Mount | A44C 17/0208 | 63/1.11 |
| 8,496,483 | B1 * | 7/2013 | Walters | G09B 1/14 | 434/172 |
| 2002/0116947 | A1 * | 8/2002 | Mount | A44C 17/0208 | 63/3.1 |
| 2005/0178155 | A1 * | 8/2005 | Poli | A44C 17/02 | 63/29.2 |
| 2009/0038338 | A1 * | 2/2009 | Korwin | A44C 25/001 | 63/1.11 |
| 2013/0239610 | A1 * | 9/2013 | Lim | A44C 13/00 | 63/12 |

* cited by examiner

JEWELRY WITH INTERCHANGEABLE DECORATIVE ELEMENTS

CROSS REFERENCES TO RELATED APPLICATIONS

This patent application is related to and claims the benefit of U.S. Provisional Patent Application No. 61/842,973 filed Jul. 4, 2013, entitled JEWELRY WITH INTERCHANGEABLE DECORATIVE ELEMENTS, the disclosure of which is incorporated by reference in its entirety herein.

FIELD AND BACKGROUND OF THE INVENTION

The present invention relates to jewelry.

Jewelry has been known for centuries to adorn the body. One of the earliest types of bodily adornment is the pendant. Primeval man liked to put a tiny aperture in a beautiful rock and slip a string usually made of grass or vine so it could be hung around the neck. Shells and other indigenous materials could also be used. In Ancient Egypt, Pharaohs normally wore scarab beetle pendants to symbolize their wealth and power.

SUMMARY OF THE INVENTION

Some embodiments of the present invention are related to jewelry having interchangeable decorative elements or segments which can be easily and quickly assembled and dissembled and/or reconfigured according to the particular preference or current mood of the wearer.

According to some embodiments of the present invention there is provided a jewelry system including a) a plurality of decorative segments, each of the segments including a center aperture that extends through each respective segment along a vertical axis from a top surface to a bottom surface thereof; and b) a central rod for receiving one or more of the segments, the rod including a stopper at a lower proximal end.

In some embodiments of the present invention, the diameter of the stopper is larger than the diameter of each of the center apertures of the segments, the rod further includes an eyelet at an upper proximal end. Preferably, the jewelry system also includes a chain that is received through the eyelet of the rod, and each segment is interchangeable one or more other segments.

Some embodiments of the present invention allow for decorative elements to be securely fastened and securely on a central rod. This is as opposed to threading beads and the like on a necklace which can be tricky due to the flimsiness of necklace material (whether a chain, string or the like).

Some embodiments of the present invention are such that removing the pendant from the chain and replacing the decorative segments is a simple and straightforward task which does not demand a good level of dexterity.

Some embodiments of the present invention are directed to a pendant. When assembled, the pendant features interchangeable decorative elements or segments which are threaded, via a central aperture in each of the segments, onto a vertically-oriented central rod and thereafter suspended from a chain or cord of a necklace, bracelet, earring, or similar articles of jewelry, by threading the chain or cord through an integrally-formed aperture or eyelet at the top end of the central rod. The rod includes an integrally-formed stopper at the low end to keep the decorative segments on the rod. The elements or segments can form a particular shape or name or pattern when loaded onto the rod in a desired order.

The stopper at the lower end of the rod is dimensioned so as to prevent the segments(s) from slipping off the rod at the low end. Threading a chain (neck chain, bracelet chain, rod of a brooch, earring connection piece etc.) through the eyelet keeps the segment(s) from slipping off the rod at the high end, and essentially locks the decorative elements/segment on the pendant while attaching the pendant to the necklace. Each segment can be of specific geometry, material, dimensions and can be inlayed with gemstones in any desired pattern.

Embodiments of the present invention are directed to a jewelry system. The jewelry system comprises, a plurality of segments, each of the segments comprising an aperture that extends through each of the segments, the apertures positioned in each of the segments to allow for the apertures in each of to segments to align at least substantially coaxially when the plurality of segments are brought together; and, a rod for receiving the segments and extending through the apertures of the segments, the rod including a first end including a stopper for limiting movement of the segments along the rod.

Optionally, the jewelry system is such that the apertures of each of the segments are centrally positioned in the segment, and the rod is vertically oriented for receiving each of the segments in a coaxial alignment.

Optionally, the jewelry system is such that the rod and the stopper are integrally formed as a single unit:

Optionally, the jewelry system is such that the rod further comprises an eyelet at a second end of the rod opposite to the first end of the rod.

Optionally, the jewelry system additionally comprises a cord which is received through the eyelet of the rod.

Optionally, the jewelry system is such that the segments are interchangeable with each other.

Optionally, the jewelry system is such that the segments include decorative segments.

BRIEF DESCRIPTION OF THE DRAWINGS

Some embodiments of the invention are herein described, by way of example only, with reference to the accompanying drawings, where like reference numerals or characters represent corresponding or like elements. With specific reference now to the drawings in detail, it is stressed that the particulars shown are by way of example and for purposes of illustrative discussion of-embodiments of the invention. In this regard, the description taken with the drawings makes apparent to those skilled in the art how embodiments of the invention may be practiced.

DETAILED DESCRIPTION CF THE DRAWINGS

Figure 1:
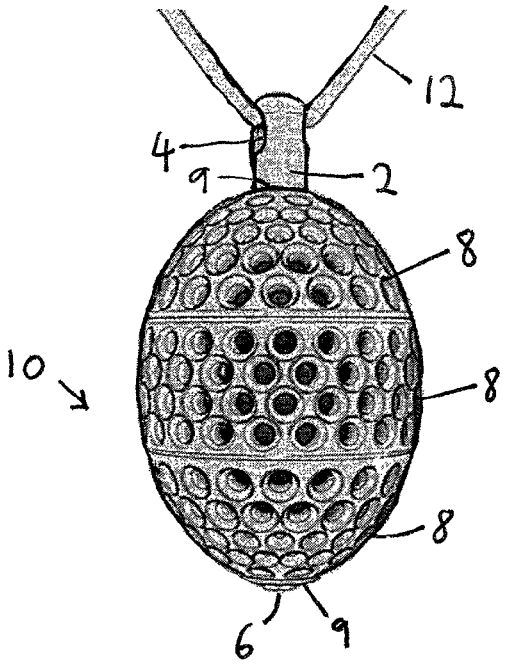
FIG. 1 is a preferred embodiment of the jewelry system of the present invention.
Figure 2:
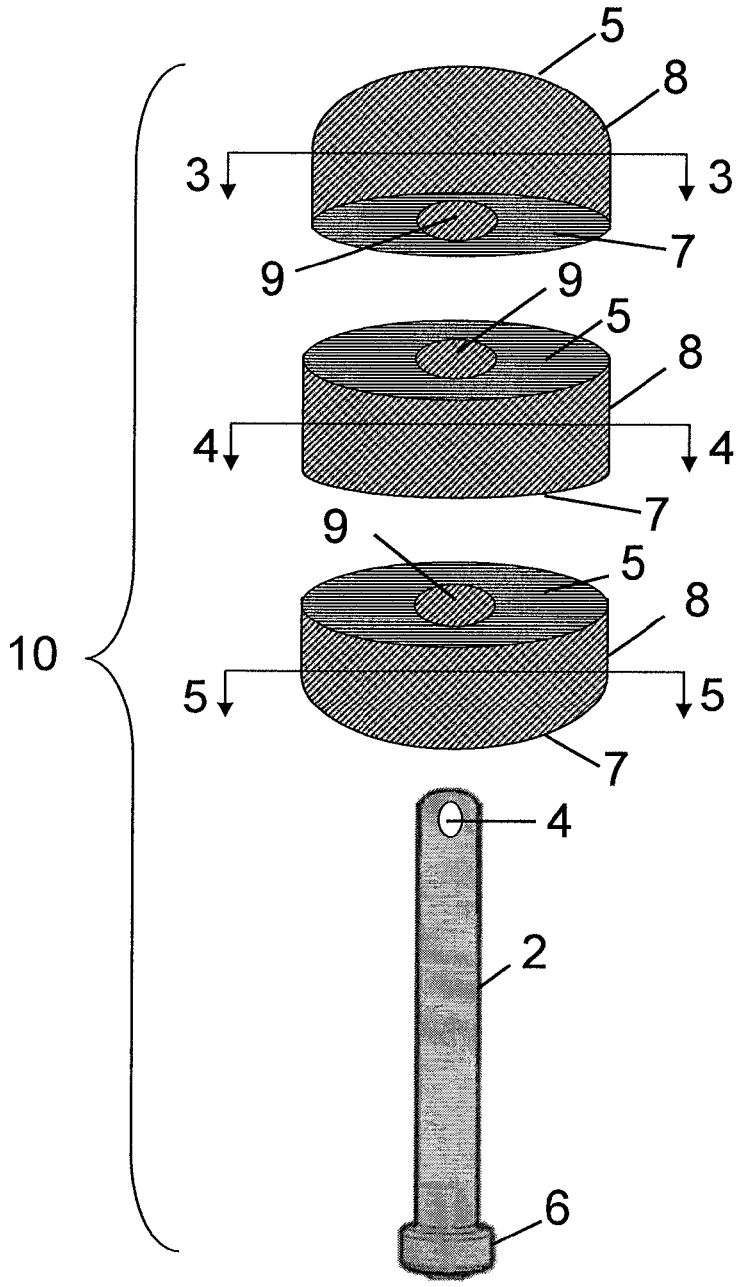
FIG. 2 is an exploded view of the preferred embodiment of the present invention.

Referring now to FIGS. 1-5, there is shown a jewelry system 1 in accordance with embodiments of the present invention, including a pendant 10. FIG. 2 illustrates an exploded view of the pendant 10 shown in FIG. 1. Pendant 10 includes decorative segments 8 and a central rod 2.

The central rod 2 is, for example, a single piece with an integrally formed stopper 6 on the one end and an eyelet 4 on the other. There are typically not any moving parts and the rod 2 itself does not need to be assembled or disassembled. The central rod 2, is also, for example, straight and solid. This allows for decorative elements, for example, the segments 8, to be easily loaded and securely attached.

Each of decorative segments 8 include an aperture 9, which is, for example centrally positioned, and which extends vertically from a top surface 5 to a bottom surface 7 of decorative segment 8. Rod 2 includes a stopper 6 at a lower proximal end and an eyelet 4 at an upper proximal end. The main body of rod 2 has a diameter smaller than the diameter of aperture 9 so that rod 2 may receive each of decorative segments 8 thereon, while stopper 6 has a diameter larger than that of aperture 9, which prevents decorative segments 8 from sliding off the lower end of rod 2. Eyelet 4 has a diameter large enough to receive an ordinary necklace or chain 12 which, when threaded through eyelet 4 serves a dual purpose, namely: enabling pendant 10 to be worn by a user, and preventing decorative segments 8 from slipping off the top end of rod 2.

The chain 12 of the necklace is threaded through the eyelet 4 which is, for example, integrally formed at the upper end (proximal end) of the central rod 2. The eyelet 4 is typically a completely closed ring, which ensures that the pendant 10 will not become dislodged from the necklace 12, even during vigorous activity such as running or dancing.

Figure 3:
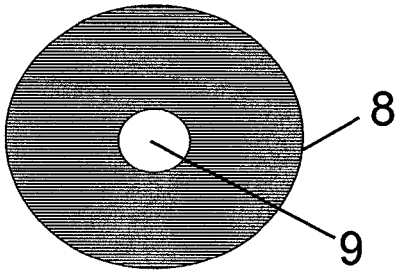
FIG. 3 is a cross-sectional view of the jewelry system of FIG. 1, taken along line 3-3 of FIG. 2.

FIG. 3 shows a cross-sectional view of top decorative segment 8 in which the aperture 9 is shown extending through a center portion of decorative segment 8.

Figure 4:
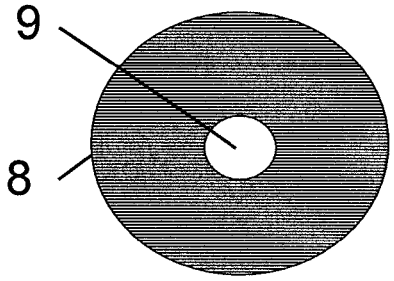
FIG. 4 is a cross-sectional view of the jewelry system of FIG. 1, taken along line 4-4 of FIG. 2; and, FIG. 5 is a cross-sectional view of the jewelry system of FIG. 1, taken along line 5-5 of FIG. 2.

FIG. 4 shows a cross-sectional view of middle decorative segment 8 in which the aperture 9 is shown extending through a center portion of decorative segment 8.

Figure 5:
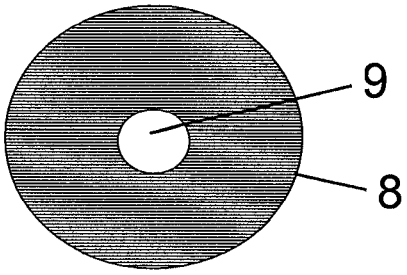

FIG. 5 shows a cross-sectional view of bottom decorative segment 8 in which the aperture 9 is shown extending through a center portion of decorative segment 8.

Each of decorative segments 8 may be interchanged with one or more other decorative segments (including decorative segments not shown) as part of the jewelry system of the present invention. The decorative segments 8 are such that they freely revolve about the axis of the central rod 2, which preferably has a circular cross-section.

The pendant 10 can be 'loaded' with any number of segments, such as segments 8, limited only by the length of the central rod 2. The pendant 10 can to alternatively be worn without any elements loaded on the rod 2. In such a case the decorative nature of the stopper 6 and the aesthetically pleasing material from which the system 1 is made add to the attractiveness of the pendant 10.

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A jewelry system comprising:

a) a pendant including:

a plurality of decorative segments, each decorative segment of the plurality of decorative segments comprising:

a top surface, a bottom surface, and an aperture that extends vertically from said top surface to said bottom surface positioned such that each aperture aligns substantially coaxially with the other apertures when said plurality of decorative segments are positioned adjacent to each other with a top surface of a first decorative segment positioned adjacent a bottom surface of a second decorative element such that the top surface is in contact with the bottom surface and wherein the first decorative element has a different shape than the second decorative element;

wherein the top surface and the bottom surface of each of said plurality of decorative segments is essentially flat, such that when the decorative segments are positioned adjacent to each other, the pendant has an outer surface that is substantially continuous across the plurality of decorative segments; and, b) a rod extending through the apertures of the plurality of decorative segments, the rod including:

a first end including a stopper, and a second end, positioned opposite the first end including a threading aperture integrally formed through said second end of said rod, wherein said rod has a first width smaller than a second width of each aperture of each decorative segment of the plurality of decorative segments and wherein said stopper has a third width larger than the second width of each aperture of each decorative segment of the plurality of decorative segments, such that when said first end of said rod is passed through each aperture of each decorative segment of the plurality of said plurality of decorative segments, said stopper prevents said plurality of decorative segments from sliding over said second end of the rod; and wherein said threading aperture of said rod is adapted to receive there-through a threadable member, such that when said threadable member is threaded through said threading aperture, said pendant is secured on said rod.

2. The jewelry system of claim 1, wherein each aperture of each decorative segment of said plurality of decorative segments is centrally positioned in each said ornamental segment, and said rod is vertically oriented to be received in each aperture of each decorative segment of the plurality of decorative segments in a coaxial alignment.

3. The jewelry system of claim 2, wherein said rod and said stopper are integrally formed as a single unit.

4. The jewelry system of claim 1, wherein each decorative segment of said plurality of decorative segments is adapted to be interchangeably positioned on said rod without interrupting the substantially continuous outer surface of the pendant.

5. The jewelry system of claim 1, further comprising said threadable member.

6. The jewelry system of claim 5, wherein said threadable member comprises a cord configured for being received through said aperture of said rod.

7. The jewelry system of claim 5, wherein said threadable member is selected from a group consisting of a necklace chain, a bracelet chain and a rod of a brooch.

8. The jewelry system of claim 5, wherein said threadable member is an earring connection piece.

9. The jewelry system of claim 1, wherein a geometrical shape of the pendant is different than a geometrical shape of each of the plurality of decorative segments.

10. The jewelry system of claim 1, wherein said plurality of decorative segments comprises at least three decorative segments.

11. The jewelry system of claim 1, wherein the cross section a width of the pendant uniformly increases from an end to a middle portion thereof.

12. The jewelry system of claim 1, wherein a fourth width of each of said plurality of decorative segments is greater than a length of the aperture in each of said segments.

13. The jewelry system of claim 1, wherein at least one of the plurality of decorative segments is annular in shape.

14. The jewelry system of claim 1 wherein pendant is widest as its center.

15. The jewelry system of claim 1, wherein the integrative pendant forms at least one of an ellipsoid, as sphere or an oval sphere.

16. The jewelry system of claim 1, wherein the pendant has at least two axes of symmetry.

17. The jewelry system of claim 1, wherein the decorative segments form an outer surface whereby the outer surface of each of said decorative segments has a width that is substantially the same as a a width of an adjacent decorative segment at the intersection of the decorative segments' flat surfaces, and wherein the flat surfaces of the plurality of decorative segments contact one another at a maximum width of each of the flat surfaces.

18. A jewelry system comprising:

a) a pendant including:

a plurality of decorative segments, each decorative segment of said plurality of decorative segments comprising:

a top surface, a bottom surface, and an aperture that extends vertically from said top surface to said bottom surface positioned each aperture aligns substantially coaxially with the other apertures when said plurality of decorative segments are positioned adjacent to each other with a top surface of a first decorative segment positioned adjacent a bottom surface of a second decorative element such that the top surface is in contact with the bottom surface and wherein a shape of the first decorative element is different from that of the second decorative element;

wherein said top surface and bottom surface of each of said plurality of decorative segments is essentially flat, such that when the decorative elements are positioned adjacent to each other, the pendant has an outer surface that is substantially continuous across the plurality of decorative segments; and, b) a rod extending though the apertures of the plurality of decorative segments, the rod comprising:

a first end including a stopper, and a second end, positioned opposite the first end including a threading aperture integrally formed through said second end of said rod, wherein said rod has a first width smaller than a second width of each aperture of each decorative segment of the plurality of decorative segments and wherein said stopper has a third width larger than the second width of each aperture of the plurality of decorative segments, such that when said first end of said rod is passed through each aperture of each decorative segment of said plurality of decorative segments, said stopper prevents said plurality of decorative segments from sliding over said second end of said rod; and wherein said threading aperture of said rod is adapted to receive there-through a threadable member, such that when said threadable member is threaded through said threading aperture, said pendant is secured on said rod.

* * * * *